US011666094B2

(12) United States Patent
Liu

(10) Patent No.: US 11,666,094 B2
(45) Date of Patent: Jun. 6, 2023

(54) ATOMIZATION ASSEMBLY AND ELECTRONIC CIGARETTE COMPRISING THE SAME

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 366 days.

(21) Appl. No.: 17/031,830

(22) Filed: Sep. 24, 2020

(65) Prior Publication Data

US 2021/0153551 A1 May 27, 2021

(30) Foreign Application Priority Data

Nov. 27, 2019 (CN) ..... 201911197371.2
Nov. 27, 2019 (CN) ..... 201922087737.2

(51) Int. Cl.
*A24F 40/42* (2020.01)
*A24F 40/485* (2020.01)
*A24F 40/10* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/10; A24F 40/485; A24F 40/40
See application file for complete search history.

(56) References Cited

U.S. PATENT DOCUMENTS

2014/0041655 A1* 2/2014 Barron ..... A24F 40/46 128/202.21
2016/0174611 A1* 6/2016 Monsees ..... A24F 40/50 392/386

FOREIGN PATENT DOCUMENTS

CN 209950402 U * 1/2020
CN 210382639 U * 4/2020
JP 2019515692 A * 6/2019

* cited by examiner

*Primary Examiner* — Jean F Duverne
(74) *Attorney, Agent, or Firm* — Matthias Scholl P.C.; Matthias Scholl

(57) ABSTRACT

An atomization assembly, including an e-liquid tank, an air admission assembly, and a ceramic module. The air admission assembly includes an air vent, an air duct, and a silicone seat. The air vent is disposed on the e-liquid tank. The silicone seat is disposed on the bottom end of the e-liquid tank to seal the e-liquid tank. The air duct passes through the silicone seat and communicates with the air vent. The ceramic module includes a U-shaped ceramic core and a strip of inert cotton. The strip of inert cotton is disposed in the U-shaped ceramic core to absorb an e-liquid condensate.

4 Claims, 6 Drawing Sheets

ATOMIZATION ASSEMBLY AND ELECTRONIC CIGARETTE COMPRISING THE SAME

CROSS-REFERENCE TO RELAYED APPLICATIONS

Pursuant to 35 U.S.C. § 119 and the Paris Convention Treaty, this application claims foreign priority to Chinese Patent Application No. 201911197371.2 filed Nov. 27, 2019, and to Chinese Patent Application No. 201922087737.2 filed Nov. 27, 2019. The contents of all of the aforementioned applications, including any intervening amendments thereto, are incorporated herein by reference.

BACKGROUND

The disclosure relates to an atomization assembly and an electronic cigarette comprising the same.

A conventional electronic cigarette includes an atomization assembly and a battery assembly. The atomization assembly includes a heating wire disposed around a strip of cotton. The e-liquid is stored in the atomizer.

SUMMARY

The disclosure provides an atomization assembly, comprising an e-liquid tank, an air admission assembly, and a ceramic module; the air admission assembly comprises an air vent, an air duct, and a silicone seat; the air vent is disposed on the e-liquid tank; the silicone seat is disposed on a bottom end of the e-liquid tank to seal the e-liquid tank; the air duct passes through the silicone seat and communicates with the air vent; the ceramic module comprises a U-shaped ceramic core and a strip of inert cotton; and the strip of inert cotton is disposed in the U-shaped ceramic core to absorb an e-liquid condensate.

In a class of this embodiment, the air admission assembly further comprises a base disposed on the bottom end of the e-liquid tank to further seal the e-liquid tank; the air duct is inserted in the base and communicates with an internal air passage of the base.

In a class of this embodiment, the ceramic module further comprises a cotton string disposed in the U-shaped ceramic core for e-liquid adsorption; and the U-shaped ceramic core is disposed in the silicone seat.

The disclosure also provides an electronic cigarette comprising the aforesaid atomization assembly and a battery assembly; the atomization assembly is disposed on the battery assembly.

In a class of this embodiment, the battery assembly comprises an air conduction assembly comprising an air conduction column and a support plate; the air conduction column comprises a sieve-shaped air vent configured to drive the support plate to work when inhaling, and to isolate the condensate in the support plate thus preventing short circuit.

In a class of this embodiment, the air conduction assembly of the battery assembly further comprises a support and a silicone ring; the support plate comprises a pneumatic switch and the silicone ring is disposed around the pneumatic switch; the silicone ring is disposed in an inner top of the support and is connected to a bottom end of the air conduction column.

The atomizer assembly is disposed on the battery assembly. The atomizer assembly comprises a steel casing and the battery assembly comprises a magnet. Through the magnetic attraction of the steel casing and the magnet, the atomizer assembly is connected to the battery assembly. The atomization assembly comprises an air admission assembly comprising an air duct for air conduction. The air duct separates the e-liquid tank from the atomizer. The atomization assembly is equipped with a U-shaped ceramic core with large transverse heating area, which is suitable for a variety of smoke materials, and the inert cotton installed on the bottom of the atomization assembly can absorb the e-liquid condensate. The air conduction column comprises a sieve-shaped air vent configured to drive the support plate to work when inhaling, and to isolate the condensate in the support plate thus preventing short circuit.

DETAILED DESCRIPTION

To further illustrate, embodiments detailing an atomization assembly and an electronic cigarette comprising the same are described below. It should be noted that the following embodiments are intended to describe and not to limit the disclosure.

Figure 1:
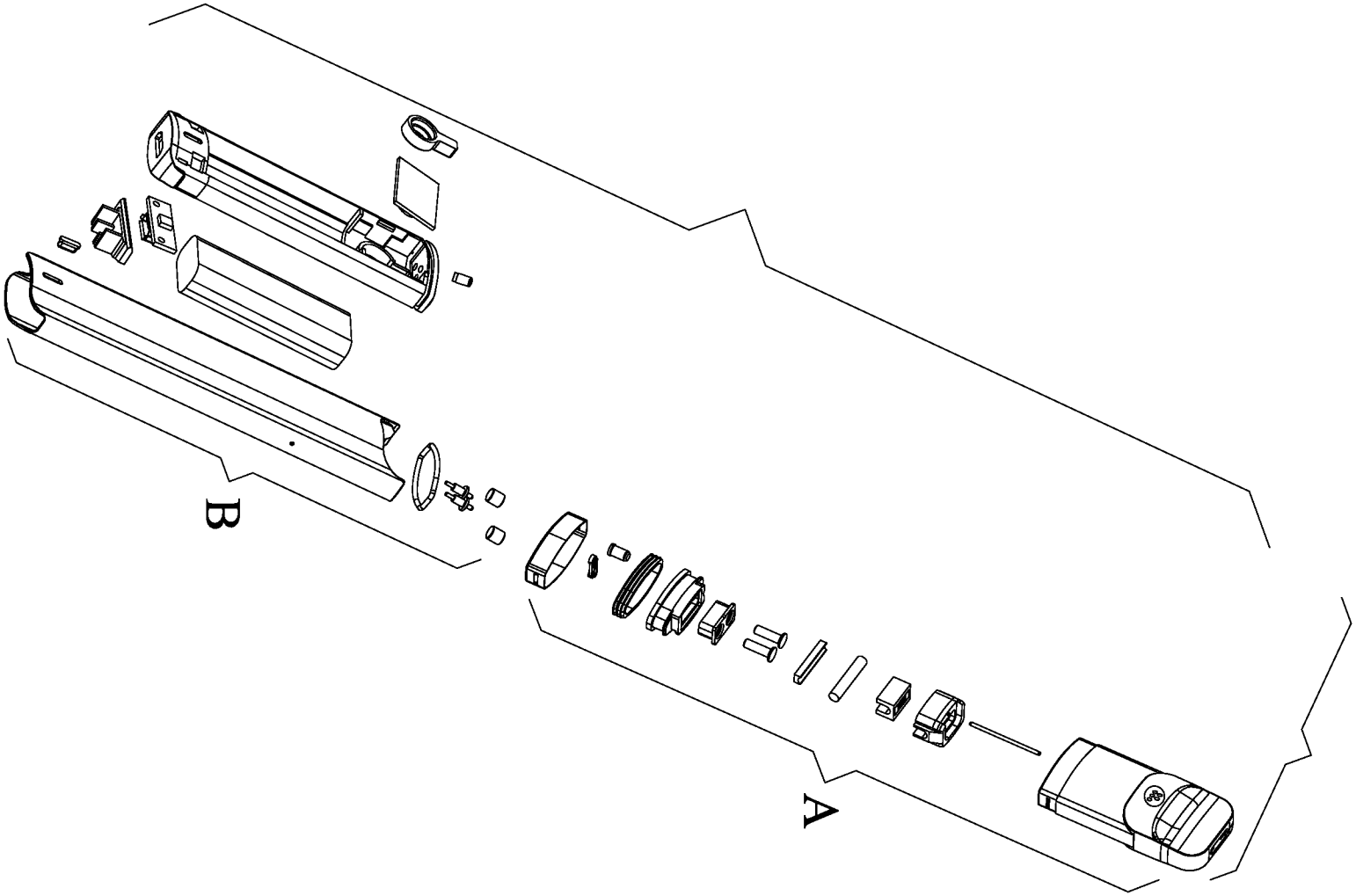
FIG. 1 is an exploded view of an electronic cigarette according to one embodiment of the disclosure.
Figure 2:
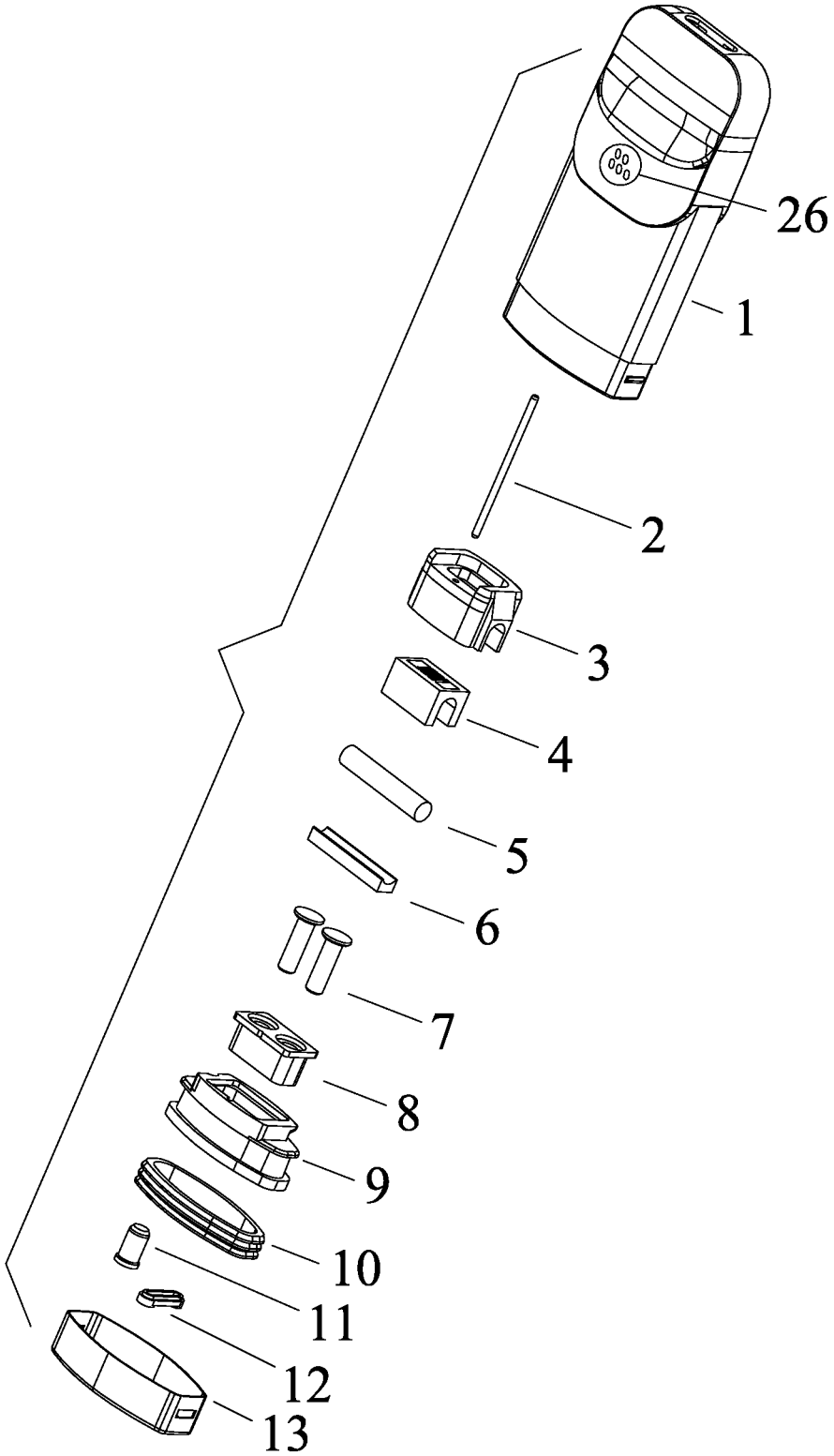
FIG. 2 is an exploded view of the atomization assembly of an electronic cigarette in FIG. 1.
Figure 3:
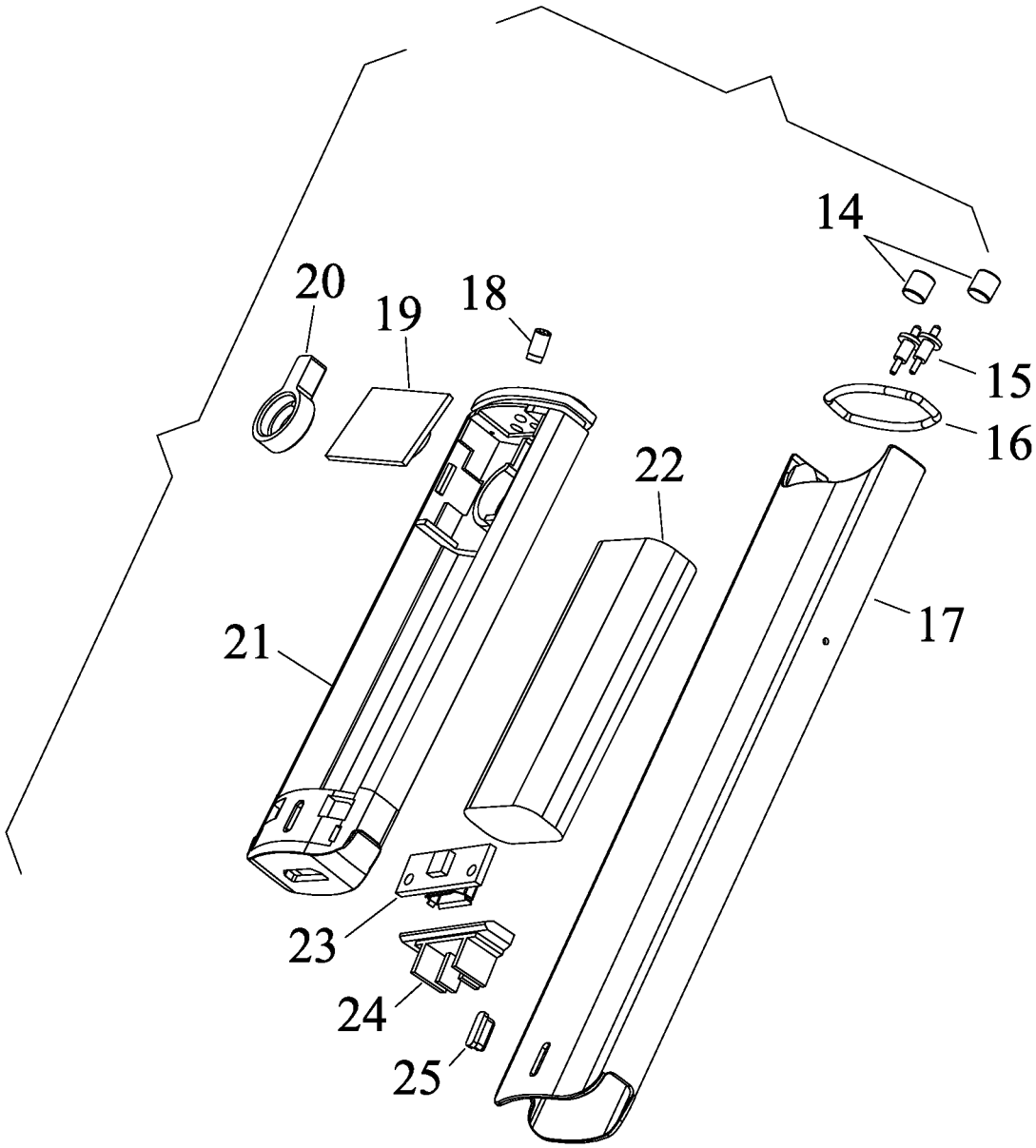
FIG. 3 is an exploded view of a battery assembly of the electronic cigarette in FIG. 1.
Figure 4:
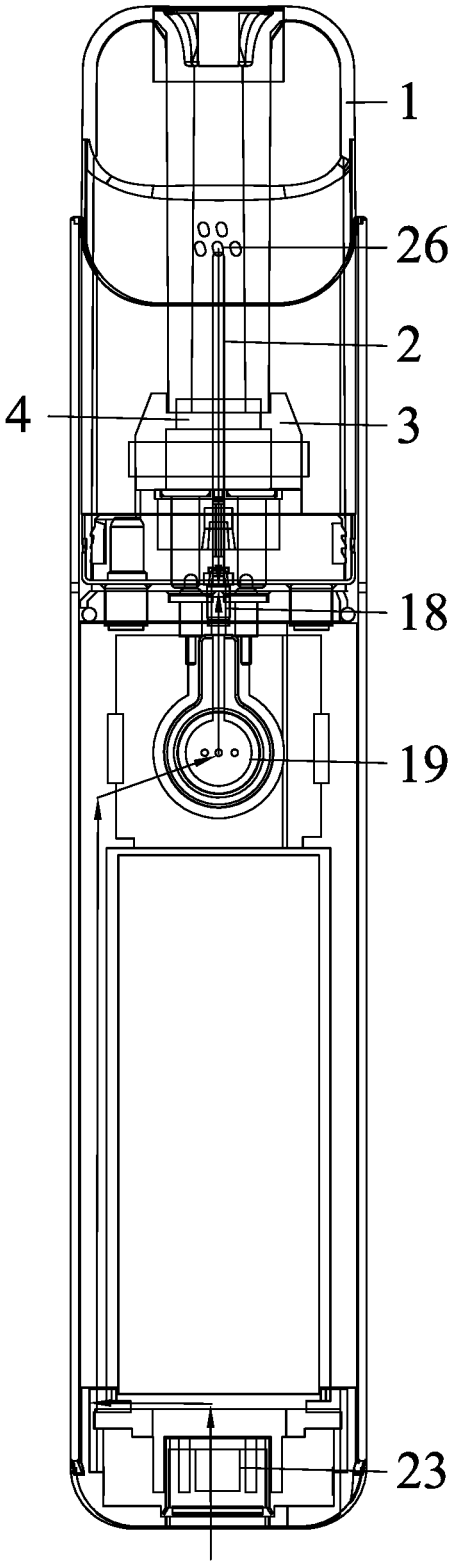
FIG. 4 is an airflow diagram of the electronic cigarette in FIG. 1.
Figure 5:
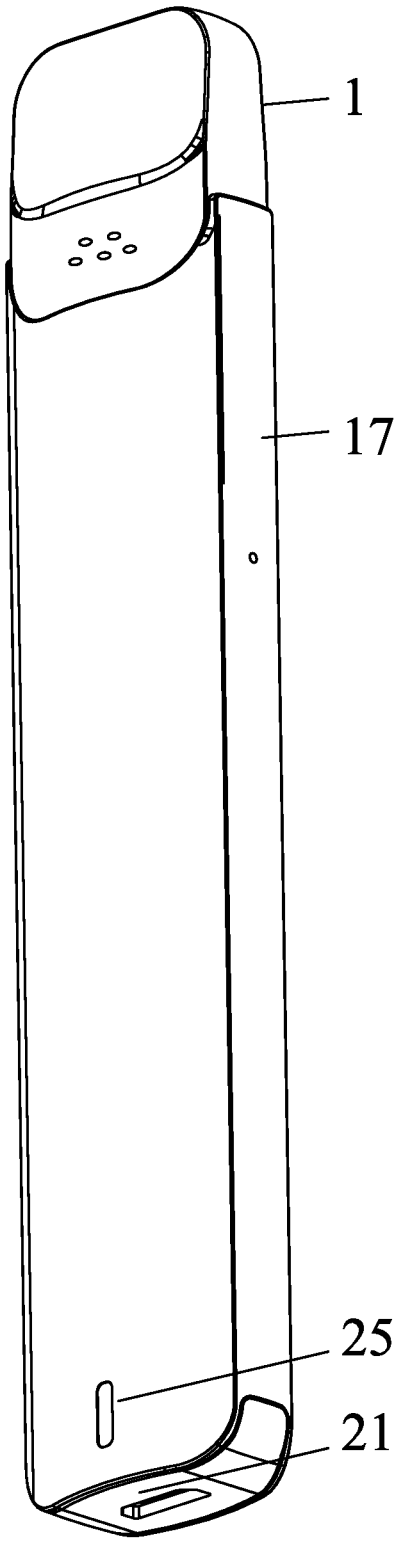
FIG. 5 is a schematic diagram of an electronic cigarette according to one embodiment of the disclosure.
Figure 6:
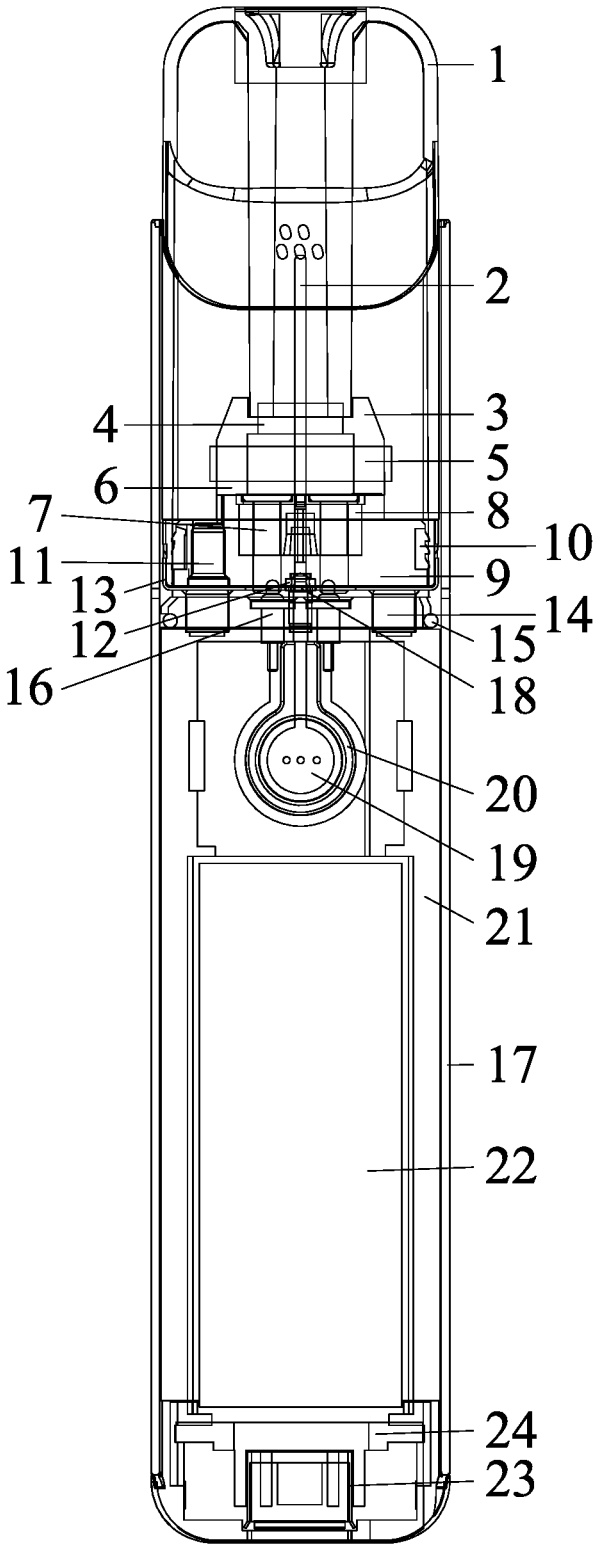
FIG. 6 is a sectional view of an electronic cigarette according to one embodiment of the disclosure.

As shown in FIGS. 1-5, an electronic cigarette comprises an atomization assembly A and a battery assembly B. The atomization assembly is disposed on one end of the battery assembly B.

The atomization assembly A comprises an e-liquid tank 1, an air duct 2, a silicone seat 3, a U-shaped ceramic core 4, a cotton string 5, a strip of inert cotton 6, a joint 7, an insulation seat 8, a base 9, a silicone seal 10, a seal plug 11, a silicone sleeve 12, and an steel casing 13. The air duct 2 is disposed in the e-liquid tank 1, communicates with the air vent 26 of the e-liquid tank 1 and isolates the e-liquid in the e-liquid tank 1. The ceramic core 4 is installed in the silicone seat 3 for accommodating and fixing the ceramic core 4. The cotton string 5 is installed in the bottom of the ceramic core 4 to adsorb the e-liquid. The inert cotton 6 is installed at the bottom of the ceramic core 4 to absorb the condensate produced at the bottom of the ceramic core 4. The air duct 2 passes through the silicone seat 3. The silicone seat 3 is disposed on the bottom end of the e-liquid tank 1 to seal the e-liquid tank 1. The joint 7 is disposed in the insulation seat 8. The insulation seat 8 is fixed on the base 9. The silicone seal 10 is disposed around the base 9 and the base 9 is disposed on the bottom end of the e-liquid tank 1. The lower end of the air duct 2 is inserted in the base 9 and communicates with the internal air passage of the base 9. The silicone sleeve 12 is dispose on the base 9 to receive the air conduction column 18 of the battery assembly. The seal plug 11 seals the e-liquid inlet of the base 9. The steel casing 13 is disposed on the bottom end of the e-liquid tank 1.

The battery assembly B comprises a magnet 14, a spring contact 15, a seal ring 16, a housing 17, an air conduction column 18, a support plate 19, a silicone ring 20, a support 21, a battery 22, a USB panel 23, a USB support 24, and a light cover 25. The seal ring 16 is disposed on the support 21 to prevent air leakage. The spring contact 15 is disposed on the top of the support 21 for electric conduction. The air conduction column 18 runs through the top part of the support 21, connects to the internal air passage of the base 9 and isolates the condensate produced on the bottom of the atomization assembly. The silicone ring 20 is disposed in the support 21. The upper part of the silicone ring 20 is connected to the lower part of the air conduction column 18 so as to drive the support plate 19 to work upon inhaling. The pneumatic switch on the support plate 19 is disposed in the silicone ring 20 and is fixed on the support 21. The USB panel 23 is fixed on the USB support 24. The USB support 24 is fixed on the bottom end of the support 21. The output end of the USB panel 23 is soldered to the support plate 19 and the support plate 19 is soldered to the battery so as to charge the battery 22. The battery 22 is disposed in the support 21. The support 21 is disposed in the housing 17. The light cover 25 is disposed in a groove on the surface of the housing 17 as a charge indicator.

The following advantages are associated with the electronic cigarette of the disclosure:

1. The atomization assembly comprises an air admission assembly comprising an air duct for air conduction. The air duct separates the e-liquid tank from the atomizer.

2. The atomization assembly is equipped with a U-shaped ceramic core with large transverse heating area, which is suitable for a variety of smoke materials, and the inert cotton installed on the bottom of the atomization assembly can absorb the e-liquid condensate.

3. The air conduction column comprises a sieve-shaped air vent configured to drive the support plate to work when inhaling, and to isolate the condensate in the support plate thus preventing short circuit.

It will be obvious to those skilled in the art that changes and modifications may be made, and therefore, the aim in the appended claims is to cover all such changes and modifications.

What is claimed is:

1. An electronic cigarette, comprising an atomization assembly and a battery assembly, wherein:

the atomization assembly comprises an e-liquid tank, an air admission assembly, and a ceramic module; the air admission assembly comprises an air vent, an air duct, and a silicone seat the air vent is disposed on the e-liquid tank; the silicone seat is disposed on a bottom end of the e-liquid tank to seal the e-liquid tank; the air duct passes through the silicone seat and communicates with the air vent; the ceramic module comprises a U-shaped ceramic core and a strip of inert cotton; and the strip of inert cotton is disposed in the U-shaped ceramic core to absorb an e-liquid condensate;

the atomization assembly is disposed on the battery assembly; and the battery assembly comprises an air conduction assembly comprising an air conduction column and a support plate; the air conduction column comprises a sieve-shaped air vent configured to drive the support plate to work when inhaling, and to isolate the condensate in the support plate thus preventing short circuit.

2. The electronic cigarette of claim 1, wherein the air admission assembly further comprises a base disposed on the bottom end of the e-liquid tank to further seal the e-liquid tank; the air duct is inserted in the base and communicates with an internal air passage of the base.

3. The electronic cigarette of claim 1, wherein the ceramic module further comprises a cotton string disposed in the U-shaped ceramic core for e-liquid adsorption; and the U-shaped ceramic core is disposed in the silicone seat.

4. The electronic cigarette of claim 1, wherein the air conduction assembly of the battery assembly further comprises a support and a silicone ring; the support plate comprises a pneumatic switch and the silicone ring is disposed around the pneumatic switch; the silicone ring is disposed in an inner top of the support and is connected to a bottom end of the air conduction column.

* * * * *